US008638029B2

(12) United States Patent
Torii et al.

(10) Patent No.: US 8,638,029 B2
(45) Date of Patent: Jan. 28, 2014

(54) SPARK PLUG FOR INTERNAL COMBUSTION ENGINE AND METHOD OF MANUFACTURING THE SPARK PLUG

(75) Inventors: Kazuyoshi Torii, Chita-gun (JP); Akira Suzuki, Nagoya (JP); Mamoru Musasa, Hurricane, VA (US)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/641,611

(22) PCT Filed: Apr. 15, 2011

(86) PCT No.: PCT/JP2011/059396

§ 371 (c)(1), (2), (4) Date: Oct. 16, 2012

(87) PCT Pub. No.: WO2011/129439

PCT Pub. Date: Oct. 20, 2011

(65) Prior Publication Data

US 2013/0038198 A1 Feb. 14, 2013

(30) Foreign Application Priority Data

Apr. 16, 2010 (JP) ..... 2010-094601

(51) Int. Cl.
*H01T 13/20* (2006.01)

(52) U.S. Cl.
USPC ..... 313/141; 445/7

(58) Field of Classification Search
USPC ..... 313/118–145; 445/7
See application file for complete search history.

(56) References Cited

U.S. PATENT DOCUMENTS

| | | | | |
|---|---|---|---|---|
| 8,469,759 | B2 * | 6/2013 | Hori et al. | 445/7 |
| 2006/0276097 | A1 | 12/2006 | Suzuki et al. | |
| 2010/0101073 | A1 | 4/2010 | Kato et al. | |
| 2010/0264801 | A1 * | 10/2010 | Tanaka et al. | 313/141 |
| 2010/0264802 | A1 * | 10/2010 | Tanaka et al. | 313/141 |

FOREIGN PATENT DOCUMENTS

| | | | |
|---|---|---|---|
| JP | 2002-231417 | A | 8/2002 |
| JP | 2003-017214 | A | 1/2003 |
| JP | 2005-158323 | A | 6/2005 |
| JP | 2008-270185 | A | 11/2008 |

OTHER PUBLICATIONS

International Search Report mailed Jul. 19, 2011 for the corresponding PCT Application No. PCT/JP2011/059396.

* cited by examiner

*Primary Examiner* — Anne Hines
(74) *Attorney, Agent, or Firm* — Leason Ellis LLP

(57) ABSTRACT

A spark plug includes a center electrode, a ground electrode, and a noble metal tip. The noble metal tip is joined to an object member of at least one of two electrodes via a fusion zone. A projected overlap region of the noble metal tip and the fusion zone accounts for 70% or more of a projected region of the noble metal tip. The object member contains at least Si out of Al and Si such that the amount of Si is 0.4% by mass or higher and such that the total amount of Al and Si is 0.5% by mass. Multi-fusion spots exist on the surface of the fusion zone. Segments of a baseline which pass through the respective multi-fusion spots have a total length of a predetermined percentage of the length of the baseline. Joining strength to the noble metal tip can thereby be greatly improved when the member to be joined contains Si.

16 Claims, 5 Drawing Sheets

SPARK PLUG FOR INTERNAL COMBUSTION ENGINE AND METHOD OF MANUFACTURING THE SPARK PLUG

CROSS-REFERENCE TO RELATED PATENT APPLICATIONS

This application is a U.S. National Phase Application under 35 U.S.C. §371 of International Patent Application No. PCT/JP2011/059396, filed Apr. 15, 2011, and claims the benefit of Japanese Patent Application No. 2010-094601, filed Apr. 16, 2010, all of which are incorporated by reference herein. The International Application was published in Japanese on Oct. 20, 2011 as International Publication No. WO/2011/129439 under PCT Article 21(2).

FIELD OF THE INVENTION

The present invention relates to a spark plug for use in an internal combustion engine and to a method of manufacturing the same.

BACKGROUND OF THE INVENTION

A spark plug for use in an internal combustion engine includes, for example, a center electrode extending in the direction of an axis; an insulator provided externally of the outer circumference of the center electrode; a cylindrical metallic shell assembled to the outer circumference of the insulator; and a ground electrode whose proximal end portion is joined to a forward end portion of the metallic shell. The ground electrode is bent at a substantially intermediate portion thereof such that a distal end portion thereof faces a forward end portion of the center electrode, thereby forming a spark discharge gap between the forward end portion of the center electrode and the distal end portion of the ground electrode.

In recent years, in order to improve erosion resistance, there is known a technique for joining a noble metal tip to the portions of the center electrode and/or the ground electrode which are adapted to form the spark discharge gap. According to a proposed method of joining the noble metal tip to an electrode (refer to, for example, Japanese Patent Application Laid-Open (kokai) No. 2005-158323), a laser beam is intermittently radiated to the edge of a contact surface between the noble metal tip and the electrode, thereby forming an annular fusion zone composed of a plurality of fusion spots which are strung out, thus joining the noble metal tip to the electrode via the fusion zone. In order to reliably join the noble metal tip to the electrode, a laser beam is radiated in such a manner that fusion spots overlap each other on the surface of the fusion zone. At this time, in order to ensure joining strength for the noble metal tip, there may be formed multi-fusion spots where three or more fusion spots overlap.

The center electrode and the ground electrode may contain aluminum (Al) and silicon (Si) unavoidably, or intentionally for improving oxidation resistance through formation of an oxide film on their surfaces.

PROBLEMS TO BE SOLVED BY THE INVENTION

The inventors of the present invention carried out extensive studies and found the following: when the center electrode and the ground electrode contain Al and Si, cracking may occur in the interior of the fusion zone (in some cases, cracking may propagate to the exterior of the fusion zone), potentially resulting in deterioration in joining strength for the noble metal tip. Thus, the inventors of the present invention carried out further studies on the cause for the occurrence of cracking and found the following: cracking is apt to occur particularly when multi-fusion spots exist on the surface of the fusion zone. Conceivably, this is for the following reason: since, in a joining process, a laser beam is radiated a plurality of times to a fusion spot in a fused condition, the spot irradiated with the laser beam is excessively heated, and is rapidly cooled in the course of solidification; as a result, the fusion spot rapidly shrinks, and Al and Si are condensed.

In view of the above findings, in order to restrain the occurrence of cracking, there is conceived a fusion zone which does not involve the formation of multi-fusion spots. However, the fusion zone which does not involve the formation of multi-fusion spots may fail to provide sufficient joining strength for the noble metal tip. That is, in view of restraint of the occurrence of cracking, a preferred fusion zone does not involve the formation of multi-fusion spots; however, in view of provision of sufficient joining strength, the formation of multi-fusion-spots is necessary.

The present invention has been conceived in view of the above circumstances, and an object of the invention is to provide a spark plug for an internal combustion engine whose center electrode and ground electrode contain Al and Si and whose fusion zone between a noble metal tip and the electrode involves the formation of multi-fusion spots on its surface and which provides greatly improved joining strength for the noble metal tip, as well as to provide a method of manufacturing the spark plug.

SUMMARY OF THE INVENTION

Means for Solving the Problems

Configurations suitable for achieving the above object will next be described in itemized form. When needed, actions and effects peculiar to the configurations will be described additionally.

Configuration 1: A spark plug for an internal combustion engine of the present configuration comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The spark plug is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 1.6% by mass; the fusion zone is formed of a plurality of fusion spots which are formed continuously through intermittent radiation of a laser beam or an electron beam; multi-fusion spots, each formed through overlap of three or more fusion spots, exist on a surface of the fusion zone; and as viewed along a baseline which passes through centers of the fusion spots on surfaces of the fusion spots, segments of the baseline which pass through the respective multi-fusion spots have a total length of 35% or less of a length of the baseline.

The "main component" refers to a component whose content in a material is the highest. Also, generally, the fusion spots each have a circular perimeter (outline) as viewed on their surfaces. However, as a result of overlapping of the fusion spots, individual perimeters may become unclear. In this case, on the basis of imaginary circles which are drawn along relatively clear perimeters of the fusion spots, the centers of the fusion spots and the sizes and positions of the multi-fusion spots as viewed on the surfaces of the fusion spots can be specified (the same also applies to the following description).

According to the above configuration 1, the object member (the center electrode or the ground electrode) contains Si in an amount of 0.4% by mass or higher, and the total amount of Al and Si is 0.5% by mass or higher. Thus, oxidation resistance of the object member can be improved.

Furthermore, since the multi-fusion spots are formed on the surface of the fusion zone, deterioration in joining strength for the noble metal tip can be prevented.

Also, as viewed on the plane of projection, the projected overlap region of the noble metal tip and the fusion zone accounts for 70% or more of the projected region of the noble metal tip. That is, the fusion zone is formed over a relatively wide region between the noble metal tip and the object member, so that the fusion zone can reliably absorb the difference in thermal expansion between the noble metal tip and the object member. As a result, there can be reliably prevented the occurrence of cracking in the boundary between the fusion zone and the noble metal tip and in the boundary between the fusion zone and the object member in association with exposure to repeated heating and cooling cycles.

Furthermore, since the object member contains Al and Si, there is concern that cracking occurs in association with formation of the multi-fusion spots. However, according to the above configuration 1, in correspondence with the total amount of Al and Si of 1.6% by mass or less in the object member, the segments of the baseline which pass through the respective multi-fusion spots have a total length of 35% or less of the length of the baseline. Therefore, there can be reduced to the greatest extent those portions of the fusion zone which are excessively heated and rapidly cooled in the course of welding, and, in turn, rapid shrinkage of the weld zone can be reliably prevented in the course of solidification. As a result, the occurrence of cracking in the interior of the fusion zone can be effectively restrained.

As mentioned above, according to the above configuration 1, while the multi-fusion spots are provided, there can be restrained the occurrence of cracking in the interior of the fusion zone and in the boundary between the fusion zone and the noble metal tip, etc. As a result, joining strength for the noble metal tip can be greatly improved.

In order to more reliably yield the above-mentioned actions and effects through formation of the multi-fusion spots, the segments of the baseline which pass through the respective multi-fusion spots have a total length of, preferably 5% or more, more preferably 10% of more, of the length of the baseline.

Configuration 2: A spark plug for an internal combustion engine of the present configuration combustion engine comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The spark plug is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 1.9% by mass; the fusion zone is formed of a plurality of fusion spots which are formed continuously through intermittent radiation of a laser beam or an electron beam; multi-fusion spots, each formed through overlap of three or more fusion spots, exist on a surface of the fusion zone; and as viewed along a baseline which passes through centers of the fusion spots on surfaces of the fusion spots, segments of the baseline which pass through the respective multi-fusion spots have a total length of 30% or less of a length of the baseline.

The inventors of the present invention carried out extensive studies and found that the higher the total amount of Al and Si, the more likely cracking is to occur in the interior of the fusion zone. Thus, as in the case of the above configuration 2, in which the total amount of Al and Si is 1.9% by mass or less, in the case where Al and Si are contained in a relatively large amount, the occurrence of cracking in the fusion zone is of greater concern.

In this regard, according to the above configuration 2, in correspondence with a relatively high total content of Al and Si of 1.9% by mass or less, the segments of the baseline which pass through the respective multi-fusion spots have a total length of 30% or less of the length of the baseline. Therefore, there can be further reduced those portions of the fusion zone which are excessively heated and rapidly cooled in the course of welding, whereby rapid shrinkage of the weld zone can be more reliably prevented. As a result, even when the occurrence of cracking is more concerned due to a relatively high total content of Al and Si, the occurrence of cracking can be more reliably restrained.

Configuration 3: A spark plug for an internal combustion engine of the present configuration combustion engine comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The spark plug is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 5.0% by mass; the fusion zone is formed of a plurality of fusion spots which are formed continuously through intermittent radiation of a laser beam or an electron beam; multi-fusion spots, each formed through overlap of three or more fusion spots, exist on a surface of the fusion zone; and as viewed along a baseline which passes through centers of the fusion spots on surfaces of the fusion spots, segments of the baseline which pass through the respective multi-fusion spots have a total length of 20% or less of a length of the baseline.

According to the above configuration 3, in correspondence with a very high total content of Al and Si of 5.0% by mass or less, the segments of the baseline which pass through the respective multi-fusion spots have a total length of 20% or less of the length of the baseline. Therefore, there can be further reduced those portions of the fusion zone which are excessively heated and rapidly cooled in the course of welding, whereby, even when the occurrence of cracking is far more concerned, the occurrence of cracking can be quite effectively restrained.

Notably, when the total amount of Al and Si exceeds 5.0% by mass, the metal material embrittles, potentially resulting in deterioration in workability.

Configuration 4; A spark plug for an internal combustion engine of the present configuration is characterized in that, in any one of the above configurations 1 to 3, the noble metal tip is provided on at least the ground electrode.

The center electrode and the ground electrode have very high temperatures in the course of use. Particularly, the ground electrode has a higher temperature than does the center electrode, since the ground electrode is located closer to the center of a combustion chamber. Also, generally, the ground electrode is disposed at the forwardmost end of the spark plug; accordingly, in association with vibration stemming from operation of an internal combustion engine, the ground electrode is subjected to a greater stress than is the center electrode. That is, the ground electrode is disposed in a severer environment in terms of temperature and vibration than is the center electrode. Therefore, the noble metal tip joined to the ground electrode must be joined with excellent joining strength.

In this regard, according to the above configuration 4, the object member to which the noble metal tip is joined is of the ground electrode; thus, the noble metal tip must be joined with excellent joining strength. Through employment of any one of the above configurations 1 to 3, a required joining strength can be more reliably implemented. In other words, the above configurations 1 to 3 are particularly effective in the case of the noble metal tip being joined to the ground electrode.

Configuration 5: A spark plug for an internal combustion engine of the present configuration is characterized in that, in the above configuration 4, a proximal end portion of the ground electrode has a cross-sectional area of 3 $mm^2$ or less.

According to the above configuration 5, the ground electrode has a cross-sectional area of a proximal end portion of 3 $mm^2$ or less; thus, the ground electrode may have a far higher temperature in the course of use. Therefore, the noble metal tip must be joined with quite excellent joining strength. Through employment of any one of the above configurations 1 to 3, sufficiently high joining strength to endure a severer environment can be implemented. In other words, the above embodiments 1 to 3 are particularly effective in the case where the noble metal tip is joined to the ground electrode and has a cross-sectional area of a proximal end portion of 3 $mm^2$ or less.

Configuration 6: A method of manufacturing a spark plug of the present configuration is a method of manufacturing a spark plug which comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The method is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 1.6% by mass; and in a step of joining the noble metal tip to the object member by means of a laser beam or an electron beam being intermittently radiated to an edge of a contact surface between the object member and the noble metal tip so as to form the fusion zone of a plurality of fusion spots which are formed continuously, the laser beam or the electron beam is radiated such that: multi-fusion spots, each formed through overlap of three or more fusion spots, exist on a surface of the fusion zone, and as viewed along a baseline which passes through centers of the fusion spots on surfaces of the fusion spots, segments of the baseline which pass through the respective multi-fusion spots have a total length of 35% or less of a length of the baseline.

The spark plug manufactured by the method of the above configuration 6 yields actions and effects similar to those yielded by the spark plug of the above configuration 1.

Configuration 7: A method of manufacturing a spark plug of the present configuration is a method of manufacturing a spark plug which comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The method is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 1.9% by mass; and in a step of joining the noble metal tip to the object member by means of a laser beam or an electron beam being intermittently radiated to an edge of a contact surface between the object member and the noble metal tip so as to form the fusion zone of a plurality of fusion spots which are formed continuously, the laser beam or the electron beam is radiated such that: multi-fusion spots, each formed through overlap of three or more fusion spots, exist on a surface of the fusion zone, and as viewed along a baseline which passes through centers of the fusion spots on surfaces of the fusion spots, segments of the baseline which pass through the respective multi-fusion spots have a total length of 30% or less of a length of the baseline.

The spark plug manufactured by the method of the above configuration 7 yields actions and effects similar to those yielded by the spark plug of the above configuration 2.

Configuration 8: A method of manufacturing a spark plug of the present configuration is a method of manufacturing a spark plug which comprises a rodlike center electrode extending in a direction of an axis; a tubular insulator provided externally of an outer circumference of the center electrode; a tubular metallic shell provided externally of an outer circumference of the insulator; a ground electrode disposed at a forward end portion of the metallic shell; and a noble metal tip formed from a noble metal alloy and joined to an object member provided at the center electrode and/or the ground electrode. The noble metal tip is joined to the object member via a fusion zone which contains components of a metal material used to form the object member, and components of the noble metal alloy used to form the noble metal tip. As viewed on a plane of projection which is orthogonal to a center axis of the noble metal tip and on which the noble metal tip and the fusion zone are projected along the center axis, a projected overlap region of the noble metal tip and the fusion zone accounts for 70% or more of a projected region of the noble metal tip. The method is characterized in that: the metal material used to form the object member contains nickel as a main component and contains at least silicon out of aluminum and silicon such that the amount of silicon is 0.4% by mass or higher and such that the total amount of aluminum and silicon is 0.5% by mass to 5.0% by mass; and in a step of joining the noble metal tip to the object member by means of a laser beam or an electron beam being intermittently radiated to an edge of a contact surface between the object member and the noble metal tip so as to form the fusion zone of a plurality of fusion spots which are formed continuously, the laser beam or the electron beam is radiated such that: multi-fusion spots, each formed through overlap of three or more fusion spots, exist on a surface of the fusion zone, and as viewed along a baseline which passes through centers of the fusion spots on surfaces of the fusion spots, segments of the baseline which pass through the respective multi-fusion spots have a total length of 20% or less of a length of the baseline.

The spark plug manufactured by the method of the above configuration 8 yields actions and effects similar to those yielded by the spark plug of the above configuration 3.

Configuration 9: A method of manufacturing a spark plug of the present configuration is characterized in that, in any one of the above configurations 6 to 8, the laser beam or the electron beam has a pulse length of 10 ms to 30 ms, and after an output of the laser beam or the electron beam reaches its peak within one pulse, the laser beam or the electron beam is radiated with an output of 30% or less of the peak output over a period of time of 50% or more of the pulse length.

According to the above configuration 9, in formation of a single fusion spot, after the output reaches its peak within one pulse, the laser beam or the like is output with an output of 30% or less of the peak output over a period of time of 50% or more of the pulse length. That is, the fusion spot is gradually cooled over a period of time of 50% or more of the pulse length. Therefore, in the course of solidification, rapid shrinkage of the individual fusion spots can be more reliably prevented, and, in turn, the occurrence of cracking in the interior of the fusion zone can be very effectively restrained.

Since a pulse length of less than 10 ms causes a failure to preheat a portion to be welded (i.e., rapid heating) and a reduction in time of gradual cooling (i.e., rapid cooling), the above-mentioned actions and effects may fail to be sufficiently yielded. A pulse length in excess of 30 ms causes an increase in the diameter of the individual fusion spots (so-called bead diameter) on the surface of the fusion zone, potentially resulting in formation of excessively large multi-fusion spots. In view of these points, preferably, the pulse length is 10 ms to 30 ms.

Configuration 10: A method of manufacturing a spark plug of the present configuration is characterized in that, in any one of the above configurations 6 to 8, the laser beam or the electron beam has a pulse length of 10 ms to 30 ms and that after an output of the laser beam or the electron beam reaches its peak within one pulse, the laser beam or the electron beam is radiated with an output of 30% or less of the peak output over a period of time of 70% or more of the pulse length.

According to the above configuration 10, after the output of the laser beam or the electron beam reaches its peak within one pulse, the laser beam or the electron beam is radiated with an output of 30% or less of the peak output over a period of time of 70% or more of the pulse length. Therefore, the individual fusion spots are cooled more gradually; as a result, the occurrence of cracking in the interior of the fusion zone can be more reliably restrained.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 3(*b*) is a projection view showing a plane of projection on which the fusion zone and a noble metal tip are projected.

DETAILED DESCRIPTION OF THE INVENTION

Modes for Carrying Out the Invention

First Embodiment

Figure 1:
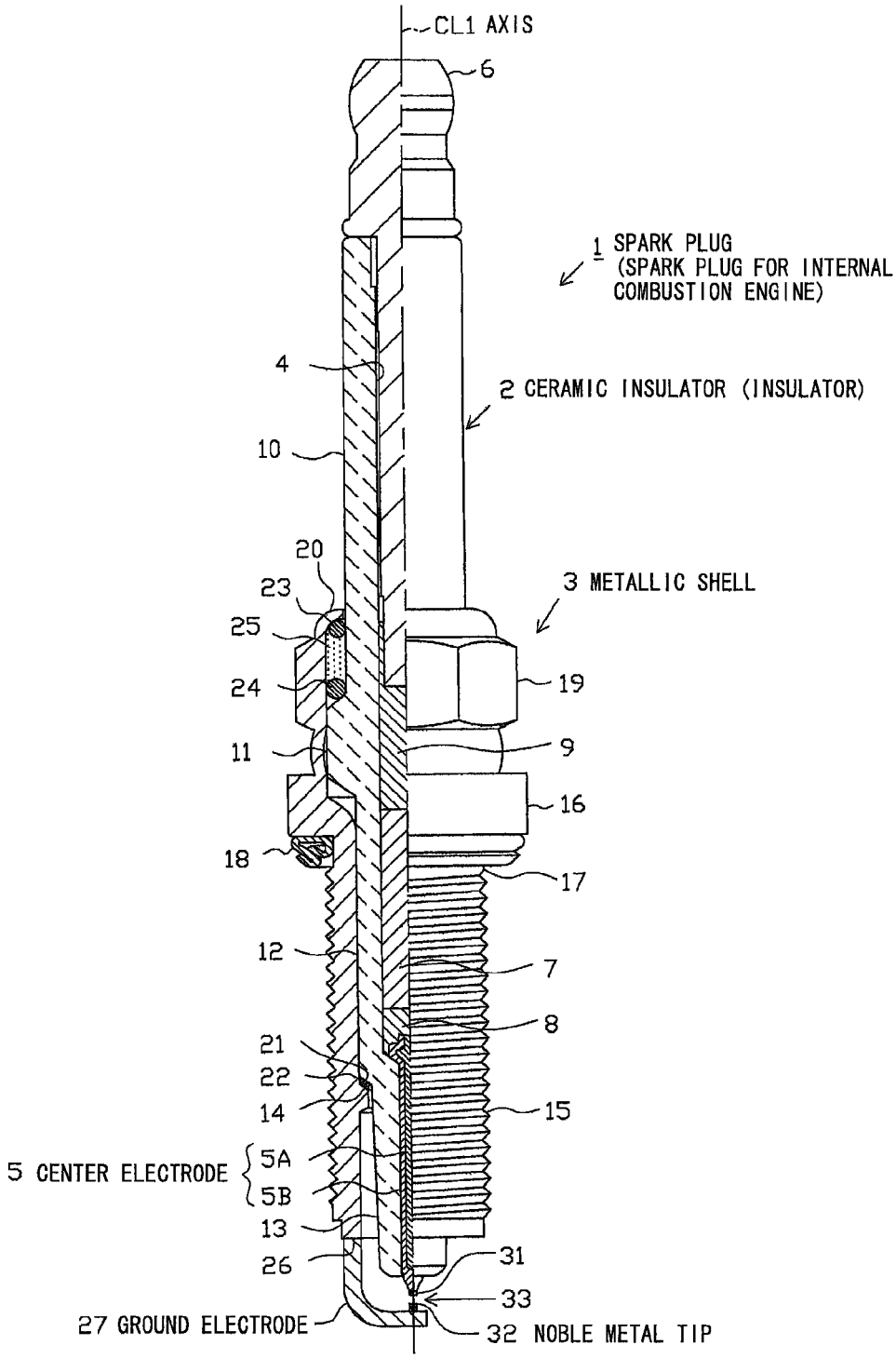
FIG. 1 is a partially cutaway front view showing the configuration of a spark plug.

An embodiment of the present invention will next be described with reference to the drawings. FIG. 1 is a partially cutaway front view showing a spark plug for an internal combustion engine (hereinafter referred to as the "spark plug") 1. In the following description, the direction of an axis CL1 of the spark plug 1 in FIG. 1 is referred to as the vertical direction, and the lower side of the spark plug 1 in FIG. 1 is referred to as the forward side of the spark plug 1, and the upper side as the rear side of the spark plug 1.

The spark plug 1 includes a ceramic insulator 2, which is an insulator in the present invention, and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Additionally, the large-diameter portion 11, the intermediate trunk portion 12, and most of the leg portion 13 of the ceramic insulator 2 are accommodated in the metallic shell 3. A tapered, stepped portion 14 is formed at a connection portion between the leg portion 13 and the intermediate trunk portion 12. The ceramic insulator 2 is seated on the metallic shell 3 via the stepped portion 14.

Furthermore, the ceramic insulator 2 has an axial bore 4 extending therethrough along the axis CL1. A center electrode 5 is fixedly inserted into a forward end portion of the axial bore 4. The center electrode 5 includes an inner layer 5A of copper or a copper alloy, and an outer layer 5B of an Ni alloy which contains nickel (Ni) as a main component. Also, the center electrode 5 assumes a rodlike (circular columnar) shape as a whole, and a forward end portion of the center electrode 5 projects from the forward end of the ceramic insulator 2. Additionally, a circular columnar noble metal member 31 of a noble metal alloy (e.g., a platinum alloy or an iridium alloy) is joined to a forward end portion of the center electrode 5.

Also, a terminal electrode 6 formed from a low-carbon steel or the like is fixedly inserted into the rear side of the axial bore 4 in such a manner as to project from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via conductive glass seal layers 8 and 9, respectively.

Additionally, the metallic shell 3 is formed from a low-carbon steel or the like and is formed into a tubular shape. The metallic shell 3 has a threaded portion (externally threaded portion) 15 on its outer circumferential surface, and the threaded portion 15 is used to attach the spark plug 1 to the engine head of an internal combustion engine. The metallic shell 3 has a seat portion 16 formed on its outer circumferential surface and located rearward of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the spark plug 1 is to be attached to the engine head. Further, the metallic shell 3 has a crimp portion 20 provided at its rear end portion and adapted to hold the ceramic insulator 2. In the present embodiment, in order to reduce the size of the spark plug 1, the metallic shell 3 is reduced in size. Accordingly, the threaded portion 15 has a relatively small thread diameter (e.g. M12 or less).

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 intervenes between the stepped portions 14 and 21. This retains gastightness of a combustion chamber and prevents leakage of fuel gas to the exterior of the spark plug 1 through a clearance between the inner circumferential surface of the metallic shell 3 and the leg portion 13 of the ceramic insulator 2, the clearance being exposed to the combustion chamber.

Furthermore, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Figure 2:
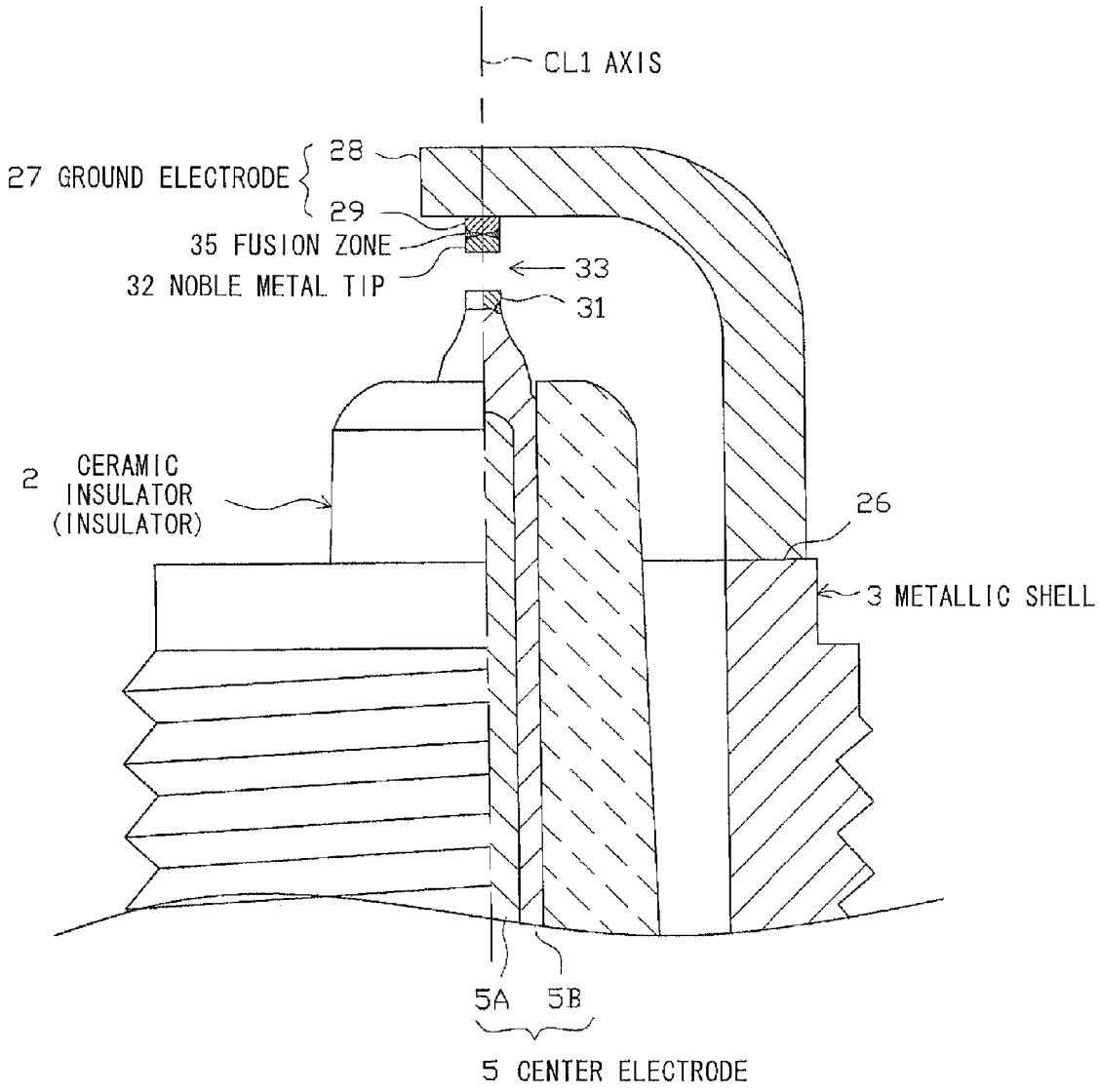
FIG. 2 is a partially cutaway, enlarged, front view showing the configuration of a forward end portion of the spark plug.

Also, as shown in FIG. 2, a ground electrode 27 is joined to a forward end portion 26 of the metallic shell 3. The ground electrode 27 is bent at its substantially intermediate portion such that the side surface of its distal end portion faces a forward end portion of the center electrode 5 (the noble metal member 31). The ground electrode 27 is composed of a hook-shaped body 28 formed from an Ni alloy and a circular columnar pedestal member 29 provided in a region of the body 28 which faces the noble metal member 31. Additionally, a circular columnar noble metal tip 32 formed from a predetermined noble metal alloy (e.g., a platinum alloy or an iridium alloy) is joined to the pedestal member 29 by laser welding (i.e., in the present embodiment, the pedestal member 29 corresponds to the "object member" in the present invention). A spark discharge gap 33 is formed between the distal end of the noble metal member 31 and the distal end of the noble metal tip 32. Spark discharge is performed across the spark discharge gap 33 substantially along the direction of the axis CL1. The pedestal member 29 is formed from an alloy whose thermal expansion coefficient is between that of an Ni alloy used to form the body 28 and that of a noble metal alloy used to form the noble metal tip 32. That is, the pedestal member 29 absorbs difference in thermal expansion between the body 28 and the noble metal tip 32.

Figure 3:
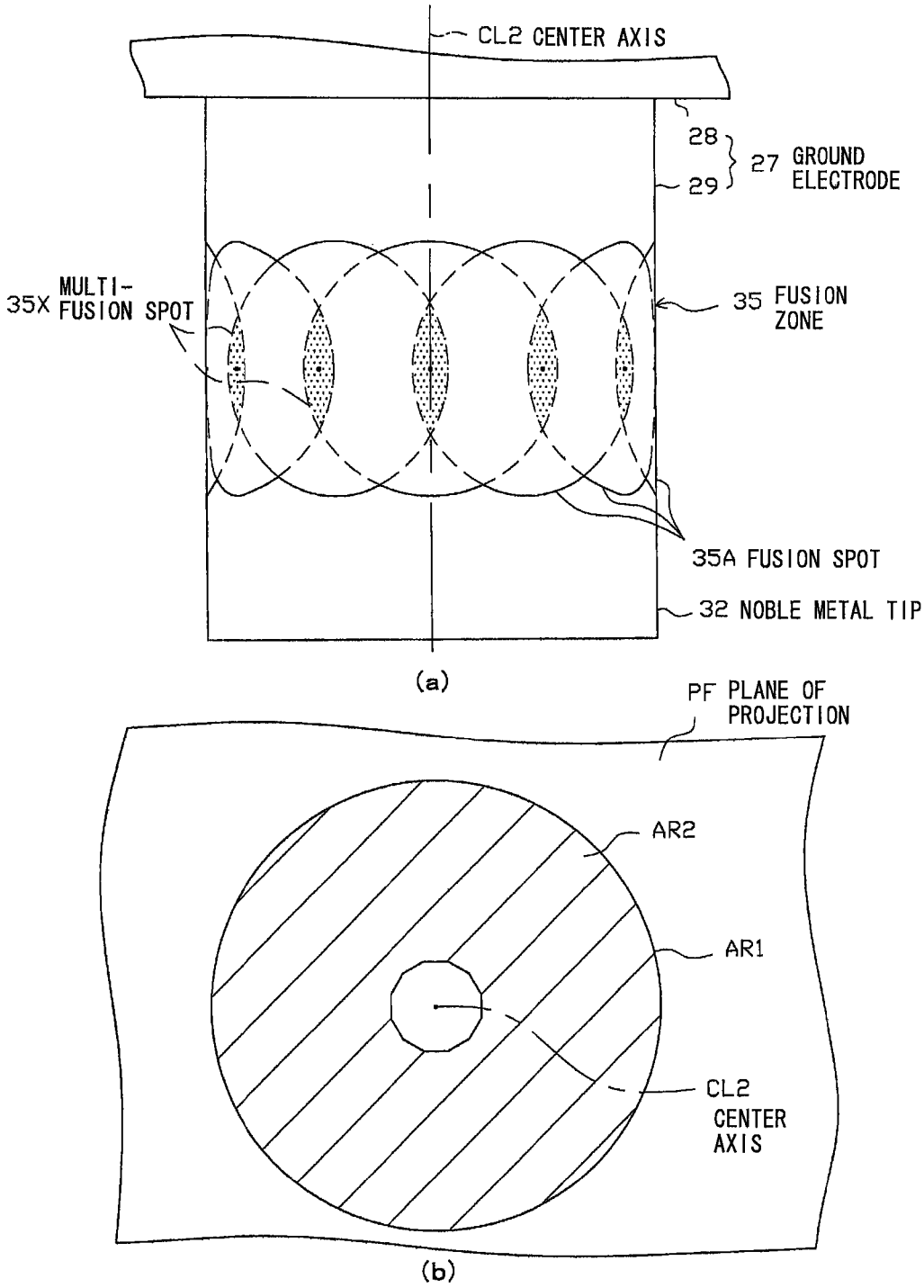
FIG. 3(*a*) is an enlarged, fragmentary, front view showing the configuration of a fusion zone, etc.

Additionally, the noble metal tip 32 is joined to the ground electrode 27 via a fusion zone 35 which contains components of a metal material used to form the ground electrode 27 (the pedestal member 29) and components of a noble metal alloy used to form the noble metal tip 32. As shown in FIG. 3(*a*), the fusion zone 35 is formed such that a plurality of (in the present embodiment, 12) fusion spots 35A are formed in an annularly continued manner through intermittent radiation of a laser beam. Also, the fusion zone 35 has a relatively large penetration depth (length from the surface of the fusion zone 35 to the innermost portion of the fusion zone 35); as a result, the fusion zone 35 extends over a relatively large region between the ground electrode 27 and the noble metal tip 32. Specifically, as shown in FIG. 3(*b*), as viewed on a plane of projection PF which is orthogonal to a center axis CL2 of the noble metal tip 32 and on which the noble metal tip 32 and the fusion zone 35 are projected along the center axis CL2, a projected overlap region AR2 of the noble metal tip 32 and the fusion zone 35 [in FIG. 3(*b*), the hatched region] accounts for 70% or more of a projected region AR1 of the noble metal tip 32 (hereinafter, the percentage is referred to as the "projected-fusion-zone occupancy").

Furthermore, the metal material used to form the pedestal member 29 contains Ni as a main component and contains, in order to improve oxidation resistance at high temperature, at least silicon (Si) out of aluminum (Al) and silicon (Si) such that the amount of silicon is 0.4% by mass or higher and such that the total amount of Al and Si is 0.5% by mass to 1.6% by mass.

Furthermore, in formation of the fusion zone 35, in order to reliably attain a projected-fusion-zone occupancy of 70% or more, a laser beam is radiated such that the surfaces of the adjacent fusion spots 35A overlap each other. In the present embodiment, as shown in FIG. 3(*a*), multi-fusion spots 35X [in FIG. 3(*a*), dotted spots], each formed through overlap of three or more fusion spots 35A, exist on the surface of the fusion zone 35.

Figure 4:
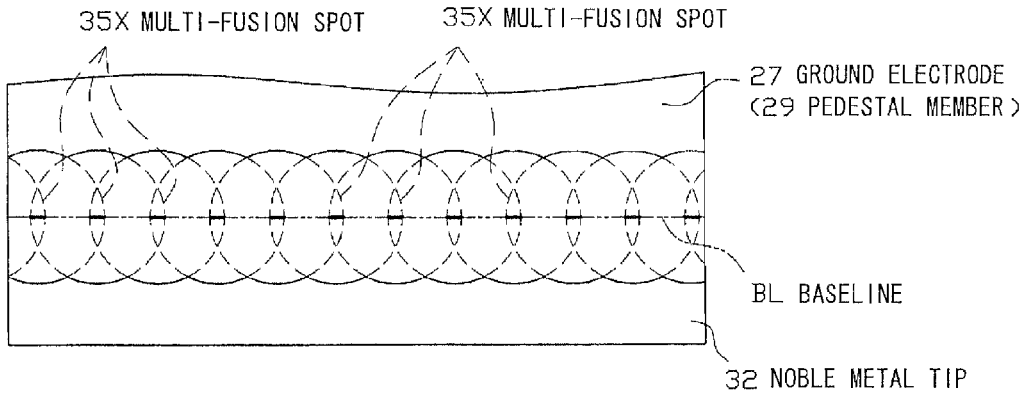
FIG. 4 is a development view showing developed outer circumferential surfaces of the fusion zone and the noble metal tip.

Meanwhile, in order to prevent the multi-fusion spots 35X from occupying an excessively large area on the surface of the fusion zone 35, the diameter of the surface of each of the fusion spots 35A (so-called bead diameter) and the interval between the fusion spots 35A are specified. Specifically, as shown in FIG. 4 (FIG. 4 is a development view showing developed outer circumferential surfaces of the fusion zone 35 and the noble metal tip 32, which each have a circular columnar shape), as viewed along a baseline BL which passes through the centers of the fusion spots 35A on the surfaces of the fusion spots 35A, segments (indicated by bold lines in FIG. 4) of the baseline BL which pass through the respective multi-fusion spots 35X have a total length of 35% or less of the length of the baseline BL (hereinafter, the percentage is referred as the "multi-fusion occupancy").

As viewed on the surfaces of the fusion spots 35A, in an overlap region where the fusion spots 35A overlap each other, the perimeters (outlines) of the individual fusion spots 35A become unclear; as a result, difficulty may be encountered in specifying the centers of the fusion spots 35A and the sizes and positions of the multi-fusion spots 35X. In this case, the perimeters of the fusion spots 35A appear relatively clearly on a side toward the noble metal tip 32 and on a side toward the ground electrode 27 (the pedestal member 29). Thus, on the basis of imaginary circles which are drawn along the relatively clear perimeters of the fusion spots 35A, the centers of the fusion spots 35A and the sizes and positions of the multi-fusion spots 35X can be specified.

Also, since, as mentioned above, the metallic shell 3 has a relatively small diameter, the ground electrode 27 (the body 28) to be joined to the forward end portion 26 of the metallic shell 3 is formed relatively thin. Specifically, a proximal end portion of the ground electrode 27 (the body 28) has a cross-sectional area of 3 $mm^2$ or less.

Next, a method of manufacturing the thus-configured spark plug 1 will be described.

First, the metallic shell 3 is formed beforehand. Specifically, a circular columnar metal material is subjected to cold forging or the like so as to form a through hole, thereby forming a general shape. Subsequently, machining is conducted so as to adjust the outline, thereby yielding a metallic-shell intermediate.

Then, the body 28 having the form of a straight bar and formed from an Ni alloy (e.g., an INCONEL alloy) is resistance-welded to the forward end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 is yielded. The metallic shell 3 to which the body 28 is welded is subjected to galvanization or nickel plating. In order to enhance corrosion resistance, the plated surface may be further subjected to chromate treatment.

Next, the noble metal tip 32 is joined to a distal end portion of the body 28 via the pedestal member 29 formed from an alloy which contains Ni as a main component as well as Al and Si.

Specifically, first, the noble metal tip 32 is placed on the end surface of the pedestal member 29; then, the noble metal tip 32 is supported by means of a predetermined pressing pin (not shown). Subsequently, while the noble metal tip 32 is rotated about its center axis CL2 relative to laser radiation means, a laser beam is intermittently radiated to the edge of the contact surface between the pedestal member 29 and the noble metal tip 32. By this procedure, a plurality of the fusion spots 35A are formed in an annularly continued manner about the center axis CL2 of the noble metal tip 32, whereby the pedestal member 29 and the noble metal tip 32 are joined to each other (spot welding).

In formation of the fusion spots 35A through radiation of the laser beam, the output and the position of irradiation of the laser beam are adjusted such that while the current fusion spot 35A and the preceding fusion spot 35A overlap each other, an overlap between the current fusion spot 35A and the fusion spot 35A before the preceding fusion spot 35A becomes relatively small so as to attain a multi-fusion occupancy of 35% or less.

Figure 5:
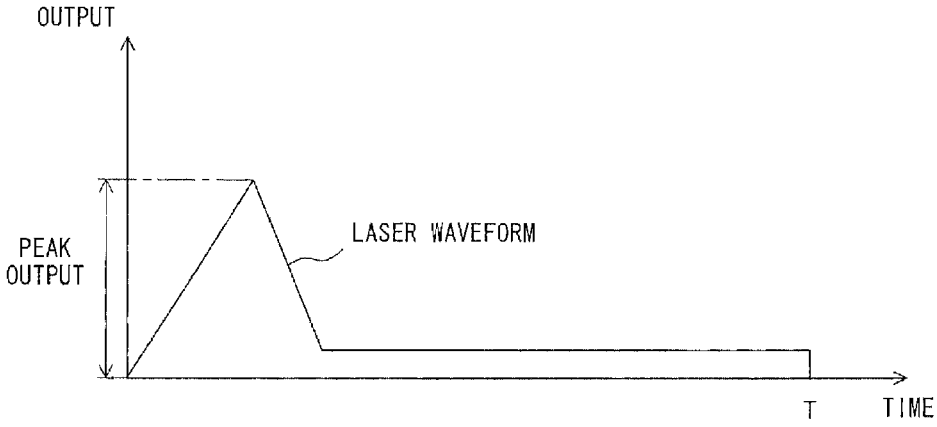
FIG. 5 is a graph showing a laser beam waveform.

Furthermore, in formation of a single fusion spot 35A, as shown in FIG. 5, the laser beam has a pulse length T of 10 ms to 30 ms, and after the output of the laser beam reaches its peak within one pulse, the laser beam is radiated with an output of 30% or less of the peak output over a period of time of 50% or more (more preferably 70% or more) of the pulse length T. As a result of irradiation with the laser beam, thermal energy is accumulated in the noble metal tip 32 and the pedestal member 29; thus, in order to adjust the amount of fusion, the output energy of the laser beam may be reduced stepwise. The amount of fusion may be adjusted by means of the focal length of the laser beam being varied while the output energy is held unchanged or is varied.

Next, the pedestal member 29 to which the noble metal tip 32 is joined is resistance-welded to a distal end portion of the body 28. For more reliable welding, plating is removed from a welding region prior to the welding, or plating is performed with a welding region masked.

Separately from preparation of the metallic shell 3, etc., the ceramic insulator 2 is formed. For example, a forming material of granular substance is prepared by use of a material powder which contains alumina in a predominant amount, a binder, etc. By use of the prepared granular substance, a tubular green compact is formed by rubber press forming. The thus-formed green compact is subjected to grinding for shaping. The shaped green compact is placed in a kiln, followed by firing. The fired body undergoes various kinds of grinding, thereby yielding the ceramic insulator 2.

Also, separately from preparation of the metallic shell 3 and the ceramic insulator 2, the center electrode 5 is formed. Specifically, a copper alloy piece or the like for enhancing heat radiation is disposed in a central portion of an Ni alloy piece, and the resultant workpiece is subjected to forging, thereby yielding the center electrode 5. Next, the noble metal member 31 of a noble metal alloy is joined to a forward end portion of the center electrode 5 by laser welding or the like.

Then, the ceramic insulator 2 and the center electrode 5, which are formed as mentioned above, the resistor 7, and the terminal electrode 6 are fixed in a sealed condition by means of the glass seal layers 8 and 9. The glass seal layers 8 and 9 are generally formed from a mixture of borosilicate glass and a metal powder. The mixture is charged into the axial bore 4 of the ceramic insulator 2 in such a manner that the resistor 7 is sandwiched between the charged portions of the mixture. Subsequently, in a state in which the terminal electrode 6 is pressed forward from the rear side, the charged mixture is hardened through firing in a kiln. At this time, the glazed surface of the rear trunk portion 10 of the ceramic insulator 2 may be simultaneously fired so as to form a glaze layer; alternatively, the glaze layer may be formed beforehand.

Subsequently, the thus-formed ceramic insulator 2 having the center electrode 5 and the terminal electrode 6, and the metallic shell 3 having the ground electrode 27 are assembled together. More specifically, in a state in which the ceramic insulator 2 is inserted through the metallic shell 3, a relatively thin-walled rear-end opening portion of the metallic shell 3 is crimped radially inward; i.e., the above-mentioned crimp portion 20 is formed, thereby fixing the ceramic insulator 2 and the metallic shell 3 together.

Finally, the ground electrode 27 is bent, and the magnitude of the spark discharge gap 33 between the noble metal member 31 and the noble metal tip 32 is adjusted, thereby yielding the above-mentioned spark plug 1.

As described in detail above, according to the present embodiment, the pedestal member 29 contains Si in an amount of 0.4% by mass or more and contains Al and Si in a total amount of 0.5% by mass or more. Therefore, oxidation resistance of the pedestal member 29 can be improved.

Furthermore, since the multi-fusion spots 35X are formed on the surface of the fusion zone 35, deterioration in joining strength for the noble metal tip 32 can be prevented.

Also, as viewed on the plane of projection PF, the projected overlap region AR2 of the noble metal tip 32 and the fusion zone 35 accounts for 70% or more of the projected region AR1 of the noble metal tip 32. Thus, the fusion zone 35 can reliably absorb the difference in thermal expansion between the noble metal tip 32 and the pedestal member 29. As a result, there can be reliably prevented the occurrence of cracking in the boundary between the fusion zone 35 and the noble metal tip 32, etc., in association with exposure to repeated heating and cooling cycles.

Furthermore, in correspondence with the total amount of Al and Si of 1.6% by mass or less in the pedestal member 29, the segments of the baseline BL which pass through the respective multi-fusion spots 35X have a total length of 35% or less of the length of the baseline BL. Therefore, there can be reduced to the greatest extent those portions of the fusion zone 35 which are excessively heated and rapidly cooled in the course of welding, and, in turn, rapid shrinkage of the weld zone 35 can be reliably prevented in the course of solidification. As a result, the occurrence of cracking in the interior of the fusion zone 35 can be effectively restrained.

As mentioned above, according to the present embodiment, while the multi-fusion spots 35X are provided, there can be restrained the occurrence of cracking in the interior of the fusion zone 35 and in the boundary between the fusion zone 35 and the noble metal tip 32, etc. As a result, joining strength for the noble metal tip 32 can be greatly improved.

Furthermore, according to the present embodiment, the laser beam has a pulse length T of 10 ms or more, and, in formation of a single fusion spot 35A, after the output reaches its peak within one pulse, the laser beam is output with an output of 30% or less of the peak output over a period of time of 50% or more of the pulse length T. Therefore, in the course of solidification, rapid shrinkage of the individual fusion spots 35A can be more reliably prevented, and, in turn, the occurrence of cracking in the interior of the fusion zone 35 can be very effectively restrained.

Also, since the pulse length T is 30 ms or less, it can be more reliably prevented that the multi-fusion spots 35X are formed excessively large.

Second Embodiment

Next, a second embodiment of the present invention will be described. The second embodiment differs from the above-described first embodiment in the composition of a metal material used to form the ground electrode 27 (particularly, the pedestal member 29, to which the noble metal tip 32 is joined) and in the total length of those segments of the baseline BL which pass through the respective multi-fusion spots 35X. That is, in the second embodiment, the Al and Si contents of the pedestal member 29 can be further increased such that the total amount of Al and Si is 0.5% by mass to 1.9% by mass.

Also, the multi-fusion occupancy is specified in accordance with the change of the total amount of Al and Si in the pedestal member 29; specifically, in the second embodiment, the multi-fusion occupancy is specified as 30% or less. In order to attain a multi-fusion occupancy of 30% or less, in welding the noble metal tip 32 to the ground electrode 27, for example, the peak output of the laser beam is slightly lowered from the level of the above-described first embodiment (however, the projected-fusion-zone occupancy is specified as 70% or more).

Thus, according to the second embodiment, there is more reliably exhibited the effect of improving oxidation resistance which is implemented by means of Al and Si being contained, and the occurrence of cracking in the interior of the fusion zone 35 is restrained. Therefore, joining strength for the noble metal tip 32 can be greatly improved.

Third Embodiment

Next, a third embodiment of the present invention will be described. In the third embodiment, as compared with the above-described first and second embodiments, the Al and Si contents of the pedestal member 29 can be further increased such that the total amount of Al and Si is 0.5% by mass to 5.0% by mass.

Also, the multi-fusion occupancy is specified in accordance with the increase of the total amount of Al and Si in the pedestal member 29; specifically, in the third embodiment, the multi-fusion occupancy is specified as 20% or less. However, the projected-fusion-zone occupancy is specified as 70% or more.

Thus, according to the third embodiment, there is far more reliably exhibited the effect of improving oxidation resistance which is implemented by means of Al and Si being contained, and the occurrence of cracking in the interior of the fusion zone 35 is restrained. Therefore, joining strength for the noble metal tip 32 can be greatly improved.

Next, in order to verify actions and effects to be yielded by the above embodiments, there were manufactured spark plug samples which differed in projected-fusion-zone occupancy as effected through change of the penetration depth of the fusion zone. The spark plug samples were subjected to a temperature cycle test on board an engine. The outline of the temperature cycle test on board an engine is as follows. The samples were mounted on a 2,000 cc, straight 6-cylinder engine. The engine was operated for 100 hours on the condition that one cycle consisted of one-minute run with full throttle opening (5,000 rpm) and subsequent one-minute idling. After the elapse of 100 hours, the samples were examined for cracking in the boundary between the fusion zone and the ground electrode and in the boundary between the fusion zone and the noble metal tip. The samples free from cracking in the boundaries were evaluated as "Good," indicating that joining strength is excellent. The samples which suffered cracking were evaluated as "Poor," indicating that joining strength is inferior. Table 1 shows the results of the temperature cycle test on board an engine. The samples had a noble metal tip diameter of 0.75 mm.

TABLE 1

| Sample No. | Depth of penetration (mm) | Projected-fusion-zone occupancy (%) | Evaluation |
|---|---|---|---|
| 1 | 0.050 | 24.9 | Poor |
| 2 | 0.100 | 46.2 | Poor |
| 3 | 0.120 | 53.8 | Poor |
| 4 | 0.150 | 64.0 | Poor |
| 5 | 0.180 | 72.9 | Good |
| 6 | 0.200 | 78.3 | Good |
| 7 | 0.250 | 88.9 | Good |
| 8 | 0.300 | 96.0 | Good |
| 9 | 0.350 | 99.6 | Good |
| 10 | 0.375 | 100.0 | Good |

As shown in Table 1, the samples having a projected-fusion-zone occupancy of 70% or more (samples 5 to 10) have excellent joining strength. Conceivably, this is for the following reason: since a sufficiently wide fusion zone was formed between the ground electrode and the noble metal tip, the fusion zone was able to effectively absorb the difference in thermal expansion between the ground electrode and the noble metal tip.

Next, spark plug samples were manufactured by joining noble metal tips to respective ground electrodes (object members) which contained Ni as a main component and which differed in Al and Si contents, and in such a manner as to differ in multi-fusion occupancy as effected through adjustment of laser beam output, etc. 40 or 30 Samples were manufactured for individual multi-fusion occupancies. The samples were checked for the occurrence of cracking in the section of the fusion zone. Tables 2 and 3 show the number of samples which suffer cracking (the quantity of cracked samples), in 40 or 30 samples, and the rate of occurrence of cracking in 40 or 30 samples (incidence of cracking). Tables 2 and 3 also show, for reference, the diameter of the fusion spot (bead diameter) as measured on its surface.

The number of formed fusion spots (i.e., laser beam radiation count) was 8, 10, 12, or 18. The employed pedestal members were those which contained Al in an amount of 0.0% by mass and Si in an amount of 0.4% by mass; those which contained Al in an amount of 0.2% by mass and Si in an amount of 0.3% by mass; those which contained Al in an amount of 0.1% by mass and Si in an amount of 0.4% by mass; those which contained Al in an amount of 2.0% by mass and Si in an amount of 3.0% by mass; those which contained Al in an amount of 1.4% by mass and Si in an amount of 1.0% by mass; those which contained Al in an amount of 1.0% by mass and Si in an amount of 0.9% by mass; and those which contained Al in an amount of 0.9% by mass and Si in an amount of 0.7% by mass. The noble metal tips had a diameter of 0.75 mm. Additionally, 30 samples were manufactured for the composition of an Al content of 2.0% by mass and an Si content of 3.0% by mass, and 40 samples were manufactured for each of other compositions.

TABLE 2

| | | | Al: 0.0% by mass Si: 0.4% by mass | | Al: 0.2% by mass Si: 0.3% by mass | | Al: 0.1% by mass Si: 0.4% by mass | |
|---|---|---|---|---|---|---|---|---|
| Q'ty of fusion spots | Bead dia. (mm) | Multi-fusion occupancy (%) | Q'ty of cracked samples (n = 40) | Incidence of cracking (%) | Q'ty of cracked samples (n = 40) | Incidence of cracking (%) | Q'ty of cracked samples (n = 40) | Incidence of cracking (%) |
| 18 | 0.49 | 69.9 | 3 | 7.5 | 3 | 7.5 | 32 | 80 |
| | 0.52 | 74.5 | 3 | 7.5 | 4 | 10 | 35 | 87.5 |
| | 0.55 | 78.6 | 1 | 2.5 | 1 | 2.5 | 29 | 72.5 |
| 12 | 0.51 | 34.5 | 2 | 5.0 | 0 | 0 | 3 | 7.5 |
| | 0.54 | 40.9 | 4 | 10.0 | 2 | 5 | 13 | 32.5 |
| | 0.58 | 48.4 | 4 | 10.0 | 4 | 10 | 15 | 37.5 |
| 10 | 0.53 | 16.6 | 3 | 7.5 | 1 | 2.5 | 2 | 5 |
| | 0.55 | 21.5 | 2 | 5.0 | 2 | 5 | 2 | 5 |
| | 0.59 | 30.0 | 3 | 7.5 | 4 | 10 | 0 | 0 |
| 8 | 0.54 | 0.0 | 0 | 0.0 | 0 | 0.0 | 0 | 0.0 |
| | 0.57 | 0.0 | 0 | 0.0 | 0 | 0.0 | 0 | 0.0 |
| | 0.58 | 0.0 | 0 | 0.0 | 0 | 0.0 | 0 | 0.0 |

TABLE 3

| | | | Al: 2.0% by mass Si: 3.0% by mass | | Al: 1.4% by mass Si: 1.0% by mass | | Al: 1.0% by mass Si: 0.9% by mass | | Al: 0.9% by mass Si: 0.7% by mass | |
|---|---|---|---|---|---|---|---|---|---|---|
| Q'ty of fusion spots | Bead dia. (mm) | Multi-fusion occupancy (%) | Q'ty of cracked samples (n = 30) | Incidence of cracking (%) | Q'ty of cracked samples (n = 40) | Incidence of cracking (%) | Q'ty of cracked samples (n = 40) | Incidence of cracking (%) | Q'ty of cracked samples (n = 40) | Incidence of cracking (%) |
| 18 | 0.49 | 69.9 | 26 | 86.7 | 36 | 90 | 34 | 85 | 26 | 65 |
| | 0.52 | 74.5 | 28 | 93.3 | 34 | 85 | 35 | 87.5 | 29 | 72.5 |
| | 0.55 | 78.6 | 28 | 93.3 | 38 | 95 | 34 | 85 | 24 | 60 |
| 12 | 0.51 | 34.5 | 21 | 70.0 | 31 | 77.5 | 24 | 60 | 4 | 10 |

TABLE 3-continued

| | | | Al: 2.0% by mass Si: 3.0% by mass | | Al: 1.4% by mass Si: 1.0% by mass | | Al: 1.0% by mass Si: 0.9% by mass | | Al: 0.9% by mass Si: 0.7% by mass | |
|---|---|---|---|---|---|---|---|---|---|---|
| Q'ty of fusion spots | Bead dia. (mm) | Multi-fusion occupancy (%) | Q'ty of cracked samples (n = 30) | Incidence of cracking (%) | Q'ty of cracked samples (n = 40) | Incidence of cracking (%) | Q'ty of cracked samples (n = 40) | Incidence of cracking (%) | Q'ty of cracked samples (n = 40) | Incidence of cracking (%) |
| | 0.54 | 40.9 | 22 | 73.3 | 28 | 70 | 30 | 75 | 18 | 45 |
| | 0.58 | 48.4 | 24 | 80.0 | 33 | 82.5 | 32 | 80 | 19 | 47.5 |
| 10 | 0.53 | 16.6 | 3 | 10.0 | 2 | 5 | 3 | 7.5 | 1 | 2.5 |
| | 0.54 | 19.8 | 3 | 10.0 | 3 | 7.5 | 2 | 5 | 2 | 5 |
| | 0.55 | 21.5 | 9 | 30.0 | 9 | 22.5 | 2 | 5 | 1 | 2.5 |
| | 0.59 | 30.0 | 12 | 40.0 | 11 | 27.5 | 4 | 10 | 2 | 5 |

As shown in Table 2, the samples whose Si content is less than 0.4% by mass and the samples whose total amount of Al and Si is less than 0.5% by mass show an incidence of cracking of 10% or less, regardless of multi-fusion occupancy, indicating that these samples have excellent joining strength. Meanwhile, as shown in Tables 2 and 3, cracking is apt to occur in the samples whose Si content is 0.4% by mass or more and whose total amount of Al and Si is 0.5% by mass or more, indicating that these samples may have insufficient joining strength.

By contrast, as shown in Tables 2 and 3, the incidence of cracking drops to 10% or less in the samples whose total amount of Al and Si is 1.6% by mass or less, by virtue of employment of a multi-fusion occupancy of 35% or less; in the samples whose total amount of Al and Si is greater than 1.6% by mass to 1.9% by mass, by virtue of employment of a multi-fusion occupancy of 30% or less; and in the samples whose total amount of Al and Si is greater than 1.9% by mass to 5.0% by mass, by virtue of employment of a multi-fusion occupancy of 20% or less. This indicates that these samples have excellent joining strength.

As understood from the above test results, in view of great improvement in joining strength for the noble metal tip, preferably, the projected-fusion-zone occupancy is 70% or more; in the case where the total amount of Al and Si is 1.6% by mass or less in the object member, the multi-fusion occupancy is 35% or less; in the case where the total amount of Al and Si is 1.9% by mass or less in the object member, the multi-fusion occupancy is 30% or less; and in the case where the total amount of Al and Si is 5.0% by mass or less in the object member, the multi-fusion occupancy is 20% or less.

The present invention is not limited to the above-described embodiments, but may be embodied, for example, as follows. Of course, applications and modifications other than those exemplified below are also possible.

(a) In the above-described embodiments, an object member to which the noble metal tip 32 is joined is the ground electrode 27, and the technical ideas of the present invention are applied to joining of the noble metal tip 32 to the ground electrode 27. Alternatively, the center electrode may be an object member, and the technical ideas of the present invention may be applied to joining of the noble metal tip to the center electrode. In this case, joining strength in joining the noble metal tip to the center electrode can be improved. Also, the ideas of the present invention may be applied to both of joining of the noble metal tip to the center electrode and joining of the noble metal tip to the ground electrode.

Figure 6:
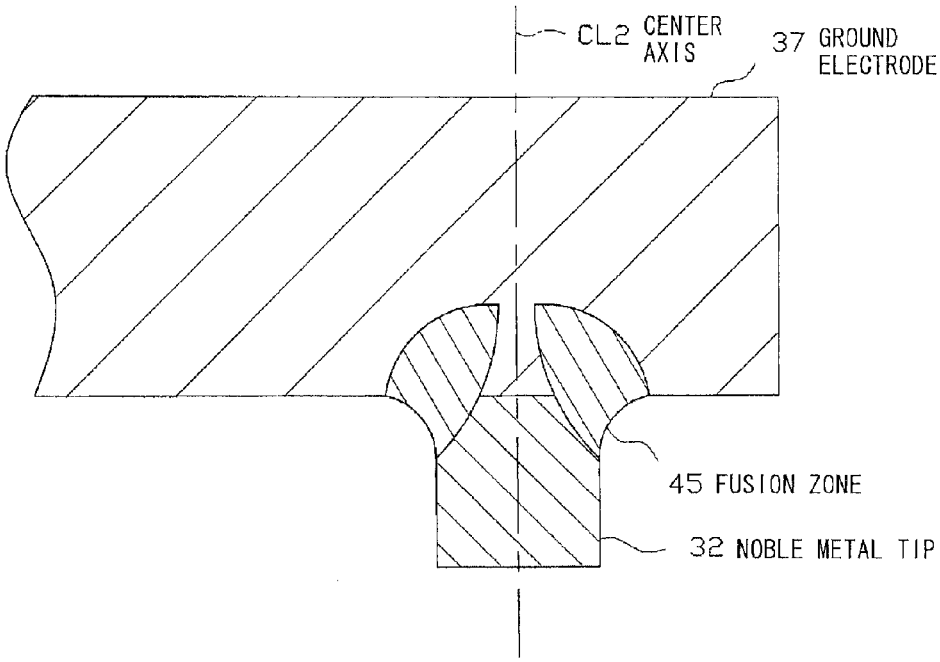
FIG. 6 is an enlarged, fragmentary, front view showing a fusion zone, etc., in another embodiment of the present invention.

(b) In the above-described embodiments, the noble metal tip 32 is joined to the pedestal member 29 of the ground electrode 27. However, as shown in FIG. 6, the noble metal tip 32 may be joined, via a fusion zone 45, to a ground electrode 37 which contains Ni as a main component and contains Al and Si in a total amount of 0.5% by mass or more, without provision of the pedestal member 29.

Figure 7:
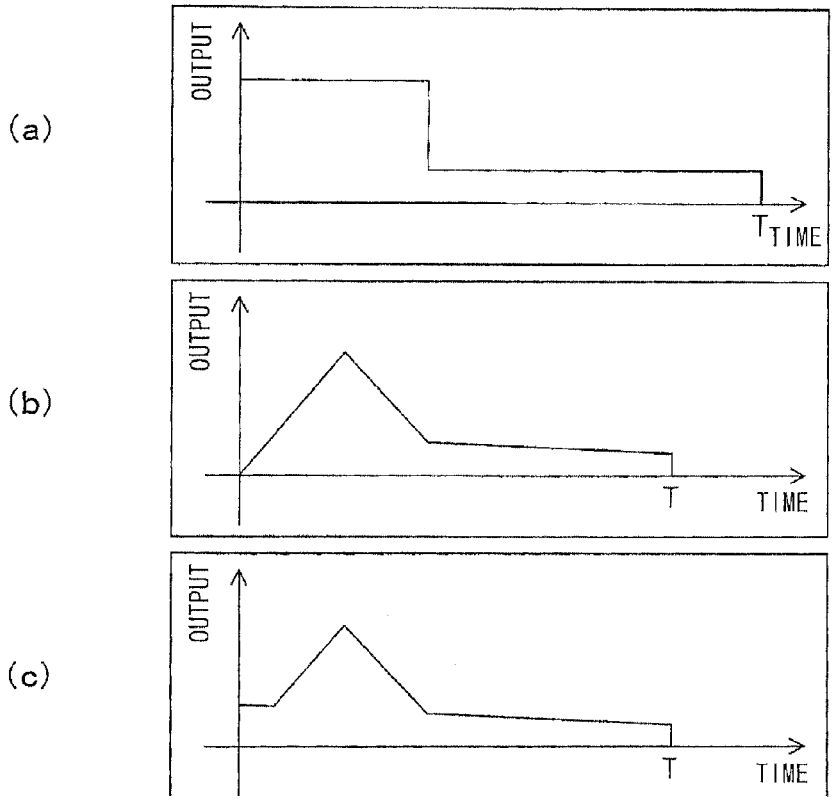
FIGS. 7(*a*) to 7(*c*) are graphs showing laser beam waveforms in further embodiments of the present invention.

(c) The waveform of the laser beam in the above-described embodiments is a mere example, and no particular limitation is imposed on the waveform. The laser may be irradiated with a waveform as shown in FIGS. 7(*a*), 7(*b*), and 7(*c*).

(d) In the above-described embodiments, the noble metal tip 32 is joined to the object member through radiation of the laser beam. However, the noble metal tip 32 may be joined to the object member through radiation of an electron beam.

(e) In the above-described embodiments, in a condition in which the noble metal tip 32 is supported by means of a predetermined pressing pin, the noble metal tip 32 is laser-welded to the ground electrode 27. However, the noble metal tip 32 may be laser-welded in a condition in which the noble metal tip 32 is temporarily fixed by resistance welding. In this case, since heat of the fusion zone 35 is not transferred through the pressing pin, rapid cooling of the fusion zone 35 can be more reliably prevented. As a result, the occurrence of cracking in the interior of the fusion zone 35 can be further restrained.

(f) In the above-described embodiments, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(g) In the above-described embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: spark plug (spark plug for internal combustion engine)
2: ceramic insulator (insulator)
3: metallic shell
5: center electrode
27, 37: ground electrode
32: noble metal tip
35, 45: fusion zone
35A: fusion spot
35X: multi-fusion spot
BL: baseline
CL1: axis CL2: center axis PF: plane of projection

The invention claimed is:

1. A spark plug for an internal combustion engine comprising:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and the noble metal alloy used to form the noble metal tip, when the noble metal tip and the fusion zone are projected along the center axis on a plane which is orthogonal to a center axis of the noble metal tip, a projected overlap region of the noble metal tip and the fusion zone accounts for 70% or more of a projected region of the noble metal tip, the object member contains nickel as a main metal component and contains at least silicon selected from the group consisting of aluminum and silicon, such that the amount of silicon is 0.4% by mass or higher and such that the total amount of aluminum and silicon is 0.5% to 1.6% by mass;

the fusion zone is composed of a plurality of fusion spots which are formed continuously through intermittent radiation of a laser beam or an electron beam;

three or more fusion spots are overlapped to form multi-fusion spots, and as viewed along a baseline which passes through centers of the fusion spots, a total length of the baseline which passes through the respective multi-fusion spots is 35% or less of the entire baseline.

2. The spark plug for an internal combustion engine according to claim 1, wherein the noble metal tip is provided on at least the ground electrode.

3. The spark plug for an internal combustion engine according to claim 2, wherein a proximal end portion of the ground electrode has a cross-sectional area of 3 $mm^2$ or less.

4. A spark plug for an internal combustion engine comprising:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and the noble metal alloy used to form the noble metal tip, when the noble metal tip and the fusion zone are projected along the center axis on a plane which is orthogonal to a center axis of the noble metal tip, a projected overlap region of the noble metal tip and the fusion zone accounts for 70% or more of a projected region of the noble metal tip, the object member contains nickel as a main metal component and contains at least silicon selected from the group consisting of aluminum and silicon, such that the amount of silicon is 0.4% by mass or higher and such that the total amount of aluminum and silicon is 0.5% to 1.9% by mass;

the fusion zone is composed of a plurality of fusion spots which are formed continuously through intermittent radiation of a laser beam or an electron beam;

three or more fusion spots are overlapped to form multi-fusion spots and as viewed along a baseline which passes through centers of the fusion spots, a total length of the baseline which passes through the respective multi-fusion spots is 30% or less of the entire baseline.

5. The spark plug for an internal combustion engine according to claim 4, wherein the noble metal tip is provided on at least the ground electrode.

6. A spark plug for an internal combustion engine comprising:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and components of the noble metal alloy used to form the noble metal tip, when the noble metal tip and the fusion zone are projected along the center axis on a plane which is orthogonal to a center axis of the noble metal tip, a projected overlap region of the noble metal tip and the fusion zone accounts for 70% or more of a projected region of the noble metal tip, the object member contains nickel as a main metal component and contains at least silicon selected from the group consisting of aluminum and silicon, such that the amount of silicon is 0.4% by mass or higher and such that the total amount of aluminum and silicon is 0.5% to 5.0% by mass;

the fusion zone is composed of a plurality of fusion spots which are formed continuously through intermittent radiation of a laser beam or an electron beam;

three or more fusion spots are overlapped to form multi-fusion spots, and as viewed along a baseline which passes through centers of the fusion spots, a total length segments of the baseline which passes through the respective multi-fusion spots is 20% or less of the entire baseline.

7. The spark plug for an internal combustion engine according to claim 6, wherein the noble metal tip is provided on at least the ground electrode.

8. A method of manufacturing a spark plug which comprises:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and the noble metal alloy used to form the noble metal tip, and when the noble metal tip and the fusion zone are projected along the center axis on a plane of projection which is orthogonal to a center axis of the noble metal tip, a projected overlap region of the noble metal tip and the fusion zone accounts for 70% or more of a projected region of the noble metal tip, the method comprising the steps of:

preparing the object member that contains nickel as a main metal component and contains at least silicon selected from the group consisting of aluminum and silicon, such that the amount of silicon is 0.4% by mass or higher and such that the total amount of aluminum and silicon is 0.5% to 1.6% by mass;

joining the noble metal tip to the object member by a laser beam or an electron beam being intermittently radiated to an edge of a contact surface between the object member and the noble metal tip so as to form the fusion zone of a plurality of fusion spots which are formed continuously; and radiating the laser beam or electron beam such that three or more fusion spots are overlapped to form multi-fusion spots, and as viewed along a baseline which passes through centers of the fusion spots, a total length of the baseline which pass through the respective multi-fusion spots is 35% or less of the entire baseline.

9. The method of manufacturing a spark plug according to claim 8, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 50% or more of the pulse length.

10. The method of manufacturing a spark plug according to claim 8, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 70% or more of the pulse length.

11. A method of manufacturing a spark plug which comprises:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and the noble metal alloy used to form the noble metal tip, and when the noble metal tip and the fusion zone are projected along the center axis on a plane of projection which is orthogonal to a center axis of the noble metal tip, a projected overlap region of the noble metal tip and the fusion zone accounts for 70% or more of a projected region of the noble metal tip, the method comprising the steps of:

preparing the object member that contains nickel as a main metal component and contains at least silicon selected from the group consisting of aluminum and silicon, such that the amount of silicon is 0.4% by mass or higher and such that the total amount of aluminum and silicon is 0.5% to 1.9% by mass;

joining the noble metal tip to the object member by a laser beam or an electron beam being intermittently radiated to an edge of a contact surface between the object member and the noble metal tip so as to form the fusion zone of a plurality of fusion spots which are formed continuously; and radiating the laser beam or electron beam such that three or more fusion spots are overlapped to form multi-fusion sports, and as viewed along a baseline which passes through centers of the fusion spots, a total length of the baseline which pass through the respective multi-fusion spots is 30% or less of the entire baseline.

12. The method of manufacturing a spark plug according to claim 11, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 50% or more of the pulse length.

13. The method of manufacturing a spark plug according to claim 11, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 70% or more of the pulse length.

14. A method of manufacturing a spark plug which comprises:

a rod-like center electrode extending in a direction of an axis;

a tubular insulator provided externally of an outer circumference of the center electrode;

a tubular metallic shell provided externally of an outer circumference of the insulator;

a ground electrode disposed at a forward end portion of the metallic shell; and a noble metal tip made of a noble metal alloy and joined to an object member provided at the center electrode and/or the ground electrode;

wherein the noble metal tip is joined to the object member via a fusion zone which contains metal components used to form the object member and the noble metal alloy used to form the noble metal tip, and when noble metal tip and the fusion zone are projected along the center axis on a plane of projection which is orthogonal to a center axis of the noble metal tip, a projected overlap region of the noble metal tip and the fusion zone accounts for 70% or more of a projected region of the noble metal tip, the method comprising the steps of:

preparing the object member that contains nickel as a main metal component and contains at least silicon selected from the group consisting of aluminum and silicon, such that the amount of silicon is 0.4% by mass or higher and such that the total amount of aluminum and silicon is 0.5% to 5.0% by mass; and joining the noble metal tip to the object member by a laser beam or an electron beam being intermittently radiated to an edge of a contact surface between the object member and the noble metal tip so as to form the fusion zone of a plurality of fusion spots which are formed continuously; and radiating the laser beam or electron beam such that three or more fusion spots are overlapped to form multi-fusion spots, and as viewed along a baseline which passes through centers of the fission spots, a total length of the baseline which pass through the respective multi-fusion spots is 20% or less of the entire baseline.

15. The method of manufacturing a spark plug according to claim 14, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 50% or more of the pulse length.

16. The method of manufacturing a spark plug according to claim 14, wherein:

the laser beam or the electron beam has a pulse length of 10 ms to 30 ms, and after an output of the beam during one pulse reaches its peak, the laser beam or the electron beam is radiated with an output of 30% or less of the peak output over a period of time of 70% or more of the pulse length.

* * * * *